US009801443B2

(12) United States Patent
Rogers

(10) Patent No.: US 9,801,443 B2
(45) Date of Patent: Oct. 31, 2017

(54) NOTCHED COVER FOR A PORTABLE, HAND-HELD ELECTRONIC DEVICE, SUCH AS AN E-BOOK READER

(71) Applicant: David Marrell Rogers, Lewisville, NC (US)

(72) Inventor: David Marrell Rogers, Lewisville, NC (US)

( * ) Notice: Subject to any disclaimer, the term of this patent is extended or adjusted under 35 U.S.C. 154(b) by 418 days.

(21) Appl. No.: 13/853,348

(22) Filed: Mar. 29, 2013

(65) Prior Publication Data

US 2014/0291172 A1 Oct. 2, 2014

(51) Int. Cl.
*B65D 85/00* (2006.01)
*A45C 11/00* (2006.01)

(52) U.S. Cl.
CPC ..... *A45C 11/00* (2013.01); *A45C 2011/003* (2013.01)

(58) Field of Classification Search
CPC . G06F 1/1628; A45C 2013/025; A45C 13/02; A45C 11/00; A45C 2011/003
USPC ..... 206/320, 701, 424, 724, 45.24, 37, 39.7, 206/472; 150/165, 104; 383/121, 123; 281/45, 26; 455/575.1, 575.8
See application file for complete search history.

(56) References Cited

U.S. PATENT DOCUMENTS

| | | | | |
|---|---|---|---|---|
| 4,395,057 | A | 7/1983 | Young | |
| 5,636,868 | A | 6/1997 | Ross, Jr. | |
| 5,957,501 | A * | 9/1999 | van Ardenne | 281/45 |
| 6,052,279 | A | 4/2000 | Friend et al. | |
| 6,356,443 | B2 | 3/2002 | Jenks et al. | |
| 6,390,712 | B1 * | 5/2002 | Urness | 402/4 |
| 6,757,156 | B2 | 6/2004 | Adams et al. | |
| D653,668 | S | 2/2012 | Song et al. | |
| 8,231,099 | B2 | 7/2012 | Chen | |
| 8,905,231 | B2 * | 12/2014 | Couch et al. | 206/320 |
| 8,910,680 | B1 * | 12/2014 | Jacobs | 150/165 |
| 2008/0237432 | A1 * | 10/2008 | Patterson | 248/458 |
| 2011/0031287 | A1 | 2/2011 | Le Gette et al. | |
| 2011/0260014 | A1 * | 10/2011 | Chen | 248/157 |
| 2011/0272088 | A1 * | 11/2011 | Cincotti | 156/247 |
| 2013/0048514 | A1 * | 2/2013 | Corcoran | A45C 11/00 206/45.23 |

* cited by examiner

*Primary Examiner* — J. Gregory Pickett
*Assistant Examiner* — Rafael Ortiz
(74) *Attorney, Agent, or Firm* — Robert W. Pitts

(57) ABSTRACT

The invention described is for a book like or portfolio style cover or case for a portable, hand held electronic device. This cover includes a notch that allows the user to more easily hold the electronic device while attached to the cover. A notch is located on at least one side provides space for the user's hand so that the electronic device rests between the user's thumb and fingers in a natural position with the fingers behind the cover so that the device can be cradled in the hand. More particularly, the cover can have front and back panels joined by a hinge into which the notch extends.

19 Claims, 12 Drawing Sheets

NOTCHED COVER FOR A PORTABLE, HAND-HELD ELECTRONIC DEVICE, SUCH AS AN E-BOOK READER

CROSS REFERENCE TO PRIOR CO-PENDING APPLICATIONS

The current application claims the benefit of prior co-pending provisional application Ser. No. 61/621,480 filed on Apr. 7, 2012.

BACKGROUND OF THE INVENTION

Field of the Invention

This invention relates to covers for use on portable, hand held electronic, computing or Internet input and output devices, such as tablet computers, cellular or mobile smart phones, e-book readers and similar devices.

Description of the Prior Art

Tablet computers and e-readers and similar type electronic devices have been on the market for a while, but with models such as the Kindle Fire, the Barnes and Noble Nook, and Apple iPad and iPad mini, the popularity of these electronic devices is greater than ever. All registered and unregistered trademarks mentioned in this application are the property of their respective owners. Traditional tablet and e-reader device covers typically protect the device from scratches and dents and some models allow the device to stand upright—hands free—for horizontal (or landscape) viewing. While these covers allow for the protection of the device, they do not typically address the human interaction of holding the device while the cover is on, sometimes making the device more difficult to hold by hand for extended periods of time.

SUMMARY OF THE INVENTION

This application describes a cover, otherwise known as a case, holder, jacket, or portfolio for a portable electronic device such as an e-reader, tablet computer, or mobile electronic device such as smart-phones. The cover allows the user to more easily hold the electronic device by utilizing the invention of a notch that is integrated into the device cover. The notch is created from the opening of a flap door that is hinged at an angle to the spine of the cover. When the cover is open and the flap is released from the back of the cover, an open area is revealed, creating a notch in the structure of the cover.

This notch creates an opening that allows the hand to access the device more securely and freely. The notch allows the user to insert their hand into the opening when the cover is open, thus allowing the user to grasp the device from the side. The cradling aspect created from the hand inserted into the notch keeps the device securely positioned in the hand with little or no grasping effort. This feature is significant in preventing user fatigue or hand/grasping fatigue that could result from extended use of holding the tablet device. The cover provides protection for the device from scratching and denting as well.

BRIEF DESCRIPTION OF THE DRAWINGS

FIG. 10 shows a more detailed exploded view of parts.

DETAILED DESCRIPTION OF EMBODIMENTS

Figure 13:
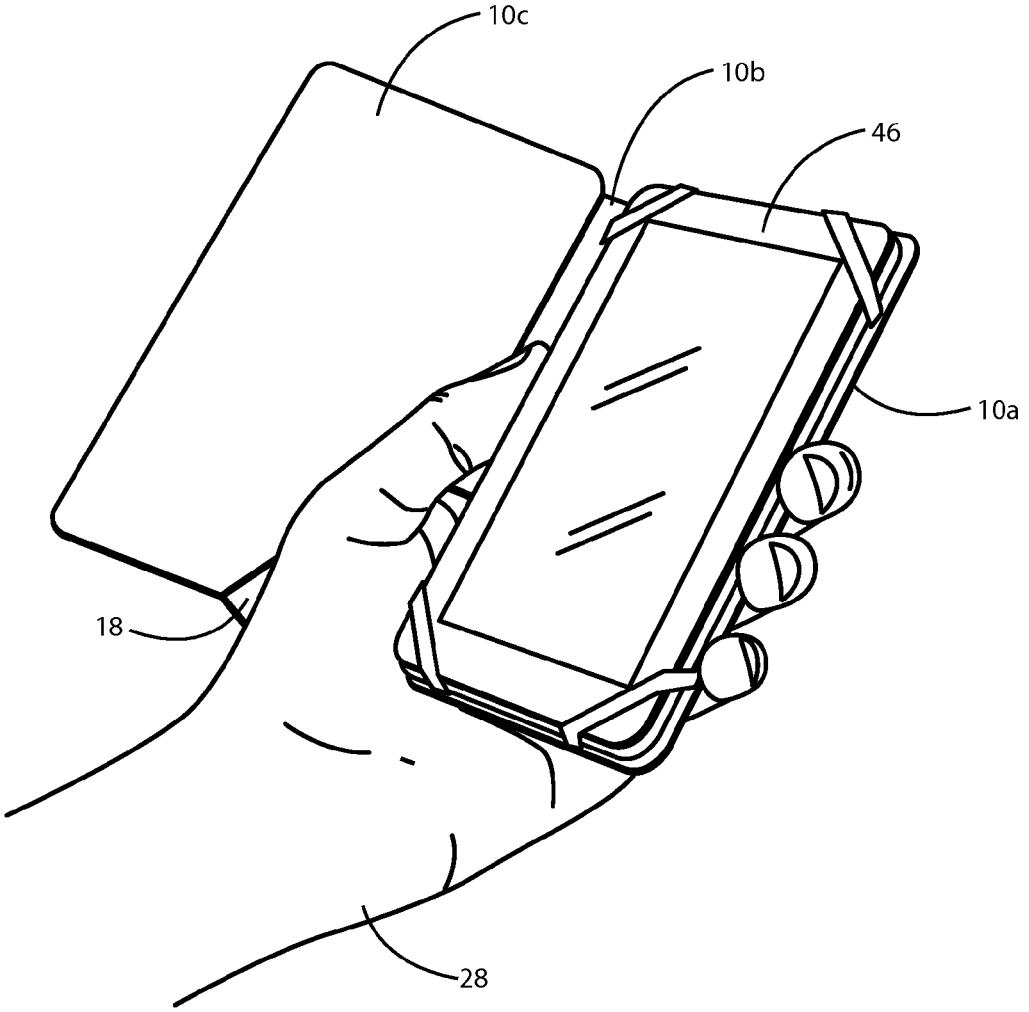
FIG. 13 shows an alternate version for a cover designed for smaller electronic devices, such as smart phones. The cover is shown open with device attached and a human hand is inserted into the notch holding the electronic device.

The unique nature of this invention is that it allows the user, utilizing a cover with the unique notch feature, to more easily hold their electronic device, devices such as, for example, e-readers and tablet computers, ie, Kindle Fire and/or iPad or iPad mini. The unique cover comes in different sizes to accommodate the variety of sizes of electronic devices, including devices as small as cell phones or "smart" phones, best seen in FIG. 13. Even though the cover sizes may differ, the function, the manufacturing, and structure are similar. The following describes certain manufacturing methods and materials for the production of the cover with the unique invention of a notch feature; however, the invention is not limited to the materials and manufacturing methods described below. The case with the notch feature, for example, could be produced from solid hard plastic materials or a combination of rigid plastic materials with flexible materials.

Figure 3:
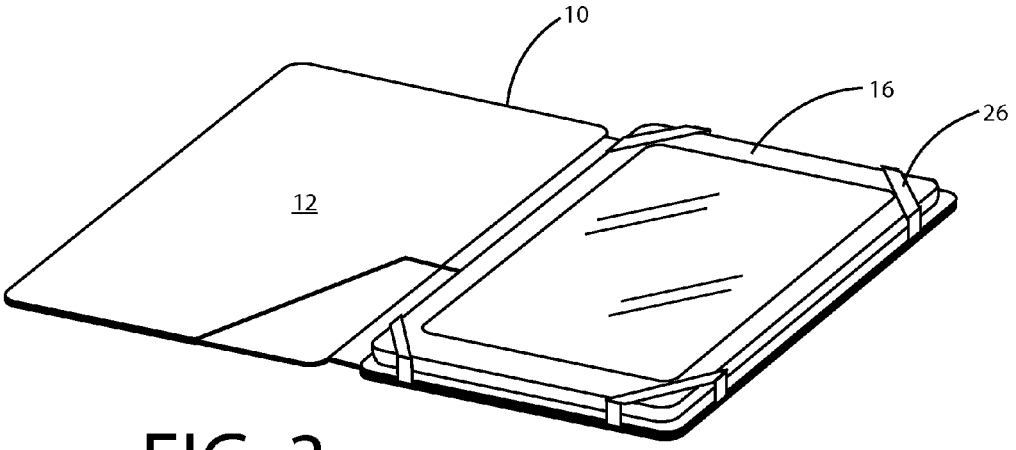
FIG. 3 shows cover in the "open" position with the electronic device exposed but securely attached with fasteners to the inside surface of electronic device cover. The flap is shown closed—unhinged—and secured to the back side of device cover.
Figure 4:
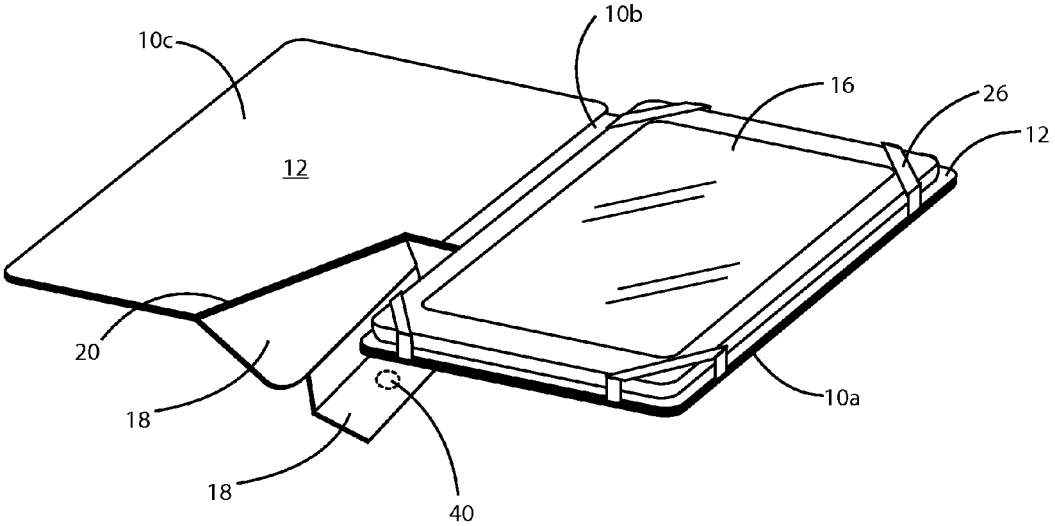
FIG. 4 shows cover in the "open" position with the electronic device exposed but securely attached with fasteners to the inside surface of electronic device cover. The hinged flap is in the "open" position, unfastened to the fastening surface on the back cover. With the hinged flap open, a tapered shaped notch, or open area, is created within the cover.
Figure 5:
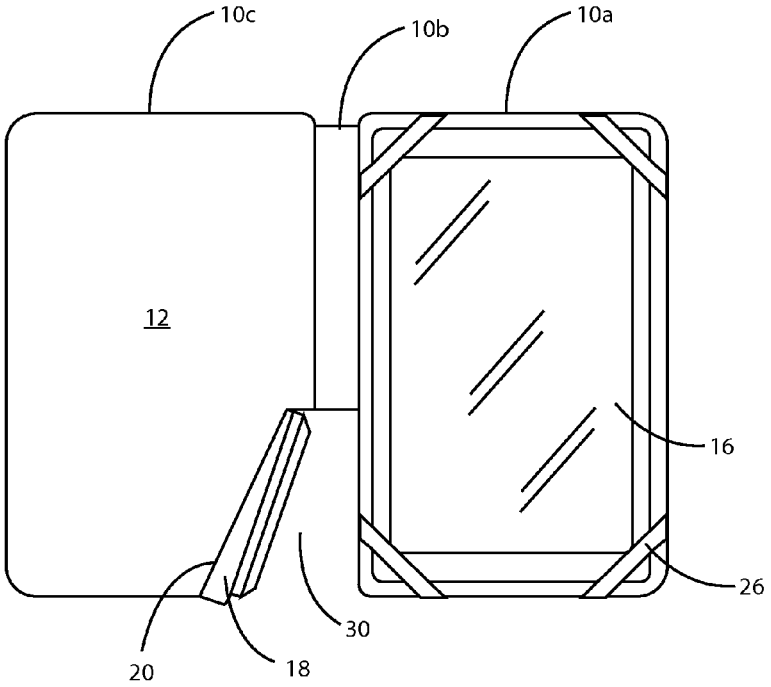
FIG. 5 shows a top view of the cover with the exposed tapered shaped notch created from the open hinged flap that is hinged downward.
Figure 6:
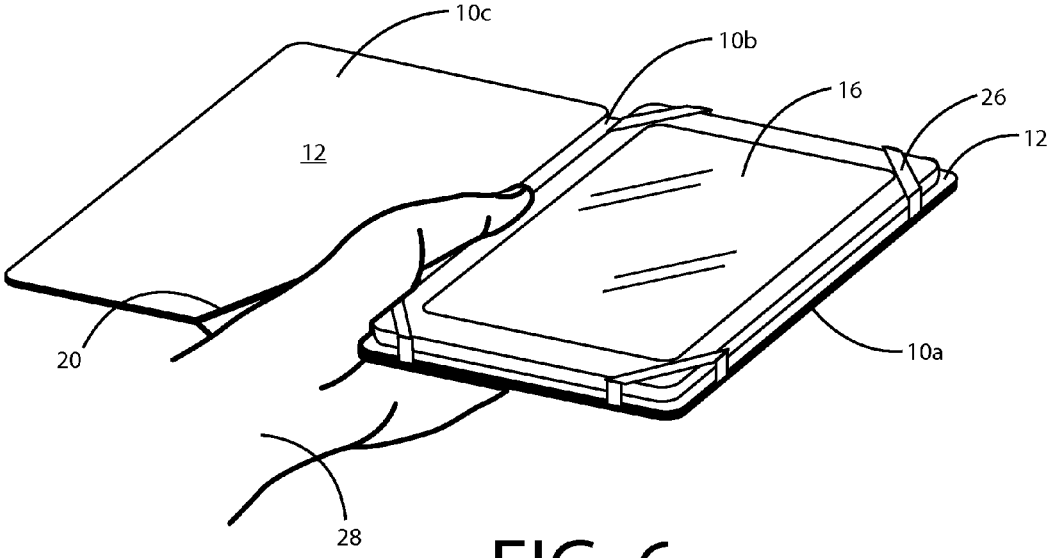
FIG. 6 shows the cover in the open position without the electronic device attached. The hinged flap is in the "open" position, exposing the tapered notch and a human hand is inserted into the notch cradling the electronic device.
Figure 16:
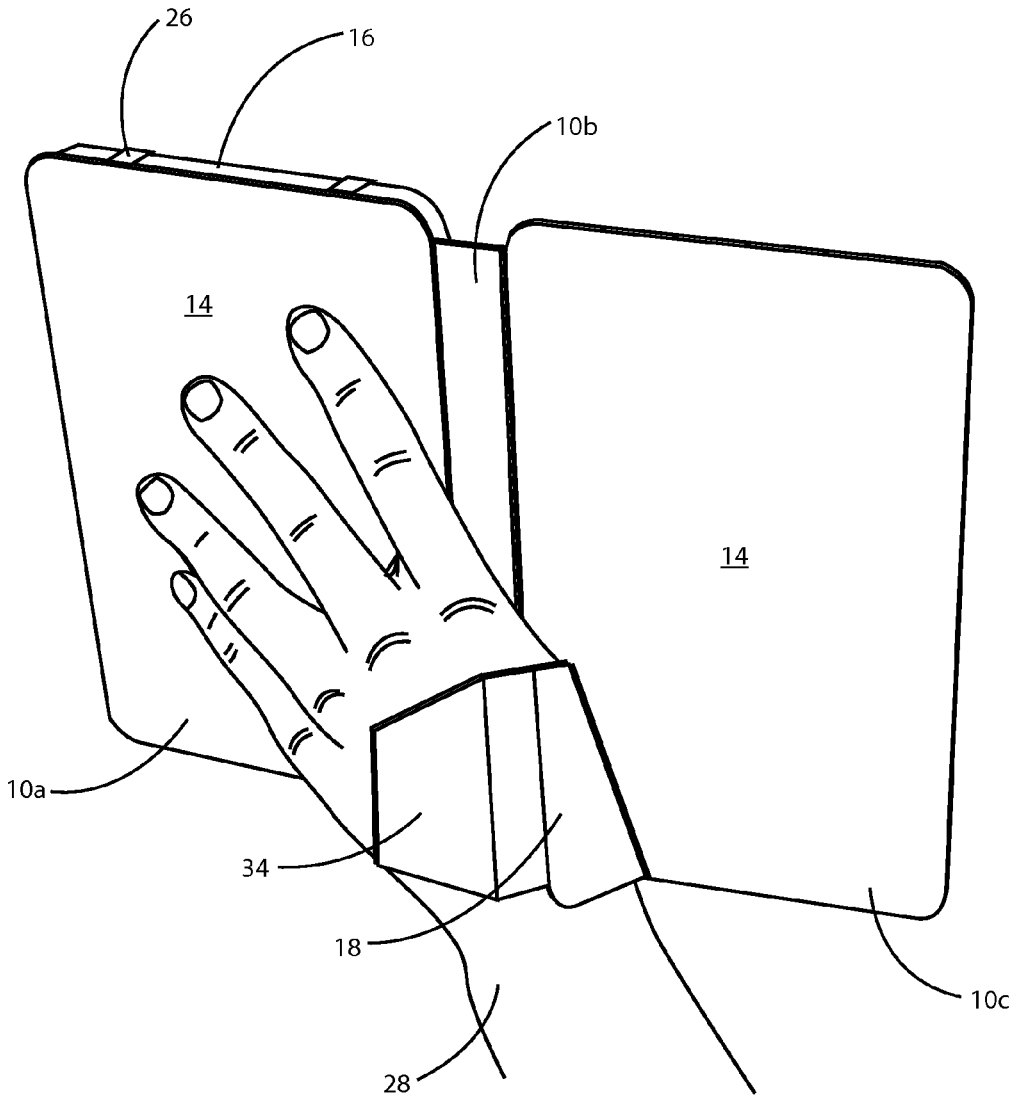
FIG. 16 shows the open device cover with a human hand that is inserted into the notch holding the electronic device. The hand is holding the device at a natural upward angle, appropriate for viewing the screen on the electronic device. The view shows the backside of the cover with the cover flap positioned on the backside of the hand.

The present invention of a cover 10 for an electronic device 16 is comprised of an integrated hinged flap 18, best seen in FIGS. 4 and 16. When the cover 10 is open and the hinged flap 18 is released from the cover's back panel 10*a*, best seen in FIGS. 3 and 4, a notch 30 or open area (best seen in FIG. 5) is exposed on the lower mid section of the cover 10. This notch 30 creates an opening that allows the hand 28 to be inserted into the mid section of cover 10 and allows the device 16 to be held and supported by the hand 28 more securely and freely, best seen in FIGS. 6 and 12. With the hand being inserted into the open notch 30, a cradling aspect is created from the natural position of the hand 28 and the cover 10, keeping the device 16 securely positioned in the hand—best seen in FIGS. 12 and 16. Much of the weight of the device 16 is transferred to the gap created between the thumb and the index finger, allowing the hand 28 to hold the device 16 while attached to the cover 10 with little or no grasping effort. The cradling aspect between the cover 10 and the hand 28 prevents the device 16 from dropping downward or moving significantly from side to side when the cover 10 is held at an angle from the flat horizontal position, best seen in FIG. 12.

Figure 2:
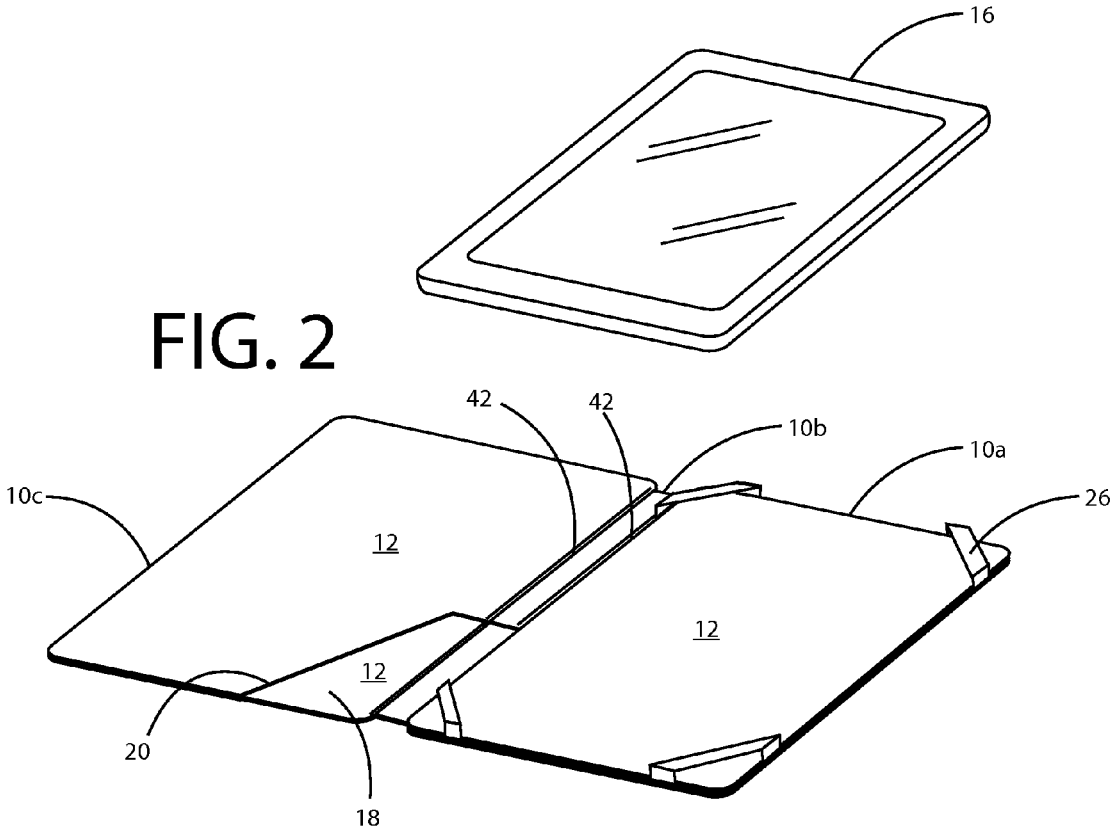
FIG. 2 shows electronic device cover in the "open" position with the electronic device above the inside cover surface used to attach electronic device with elastic fasteners or other attachment method. The flap is shown closed—unhinged—and secured to the back side of device cover.

The basic structure of the invention is a cover 10 that is slightly larger than the electronic device 16 that it encloses, best seen in FIGS. 2 and 3. The cover 10 is comprised of three panel surfaces that are hinged together to form a folding "book" like structure that encases the electronic device 16. The three surface panels consist of a back panel 10*a* that is attached by a hinge to a center (spine) panel 10*b* . The center panel 10*b* is attached by a hinge to the front panel 10*c* . These three panels, best seen in FIG. 2, form the basic foldable "book" like cover 10 structure—which the electronic device 16 is attached to.

Figure 9:
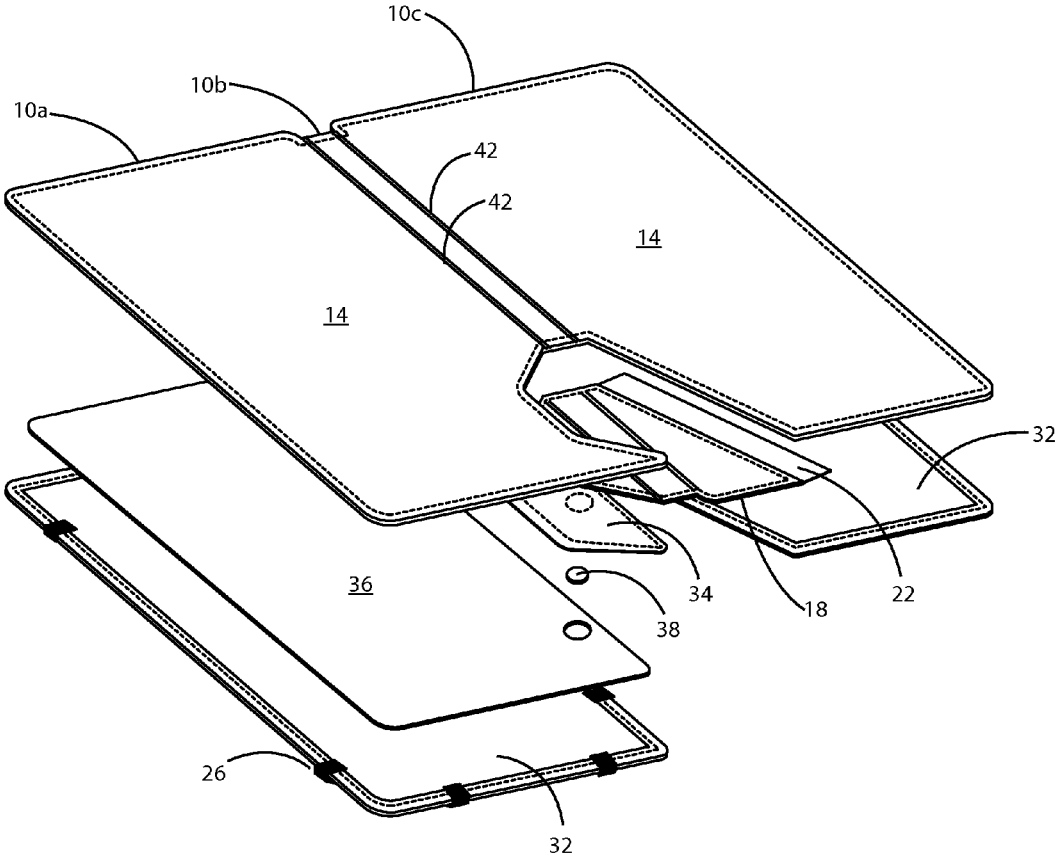
FIGS. 9 and 10 show exploded views of the components that make up the structure of the device with the back of the cover faced upward.
Figure 10:
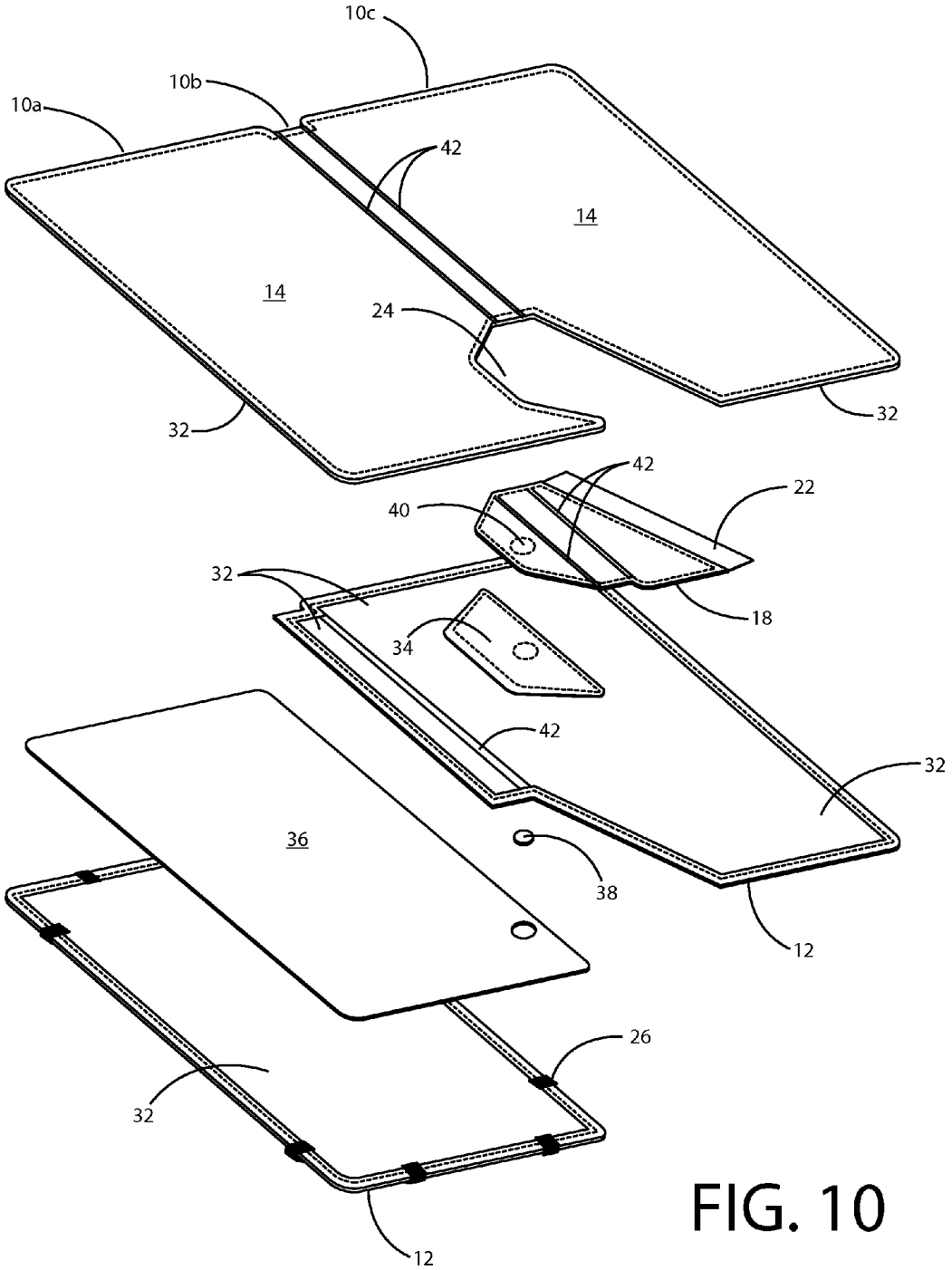

The three main panels—(back 10*a*, center 10*b*, and front 10*c*)—that make up the "book" like structure of the cover 10 are comprised of multiple materials that form an outer surface 14 (best seen in FIGS. 7 and 8) and an inner surface 12 for each panel, best seen in FIG. 2. The outer surfaces 14 (the surfaces that are exposed when the cover is closed) are comprised of a durable material such as leather, or "leather like" material, or a fabric material, best seen in FIG. 1. The inner surface 12 is comprised of a softer fabric material that is in contact with the electronic device 16 when the electronic device 16 is attached, best seen in FIGS. 3 and 4. Adhered to the outer and inner surface materials is a rigid paper board material 32 (or other thin rigid material), which gives the three main panels their rigidity, best seen in FIGS. 9 and 10. The outer and inner surfaces are glued and sewn together to form the panel structures—consisting of the back panel 10*a*, the center panel 10*b*, and the front panel 10*c*, best seen in FIGS. 9 and 10.

The three main panels—consisting of the back panel 10*a*, the center panel 10*b*, and the front panel 10*c*—are connected to each other by a continuation of panel materials that make up the cover. The main panels are separated and defined by the elimination of the rigid material 32 in-between the panels, best seen in FIG. 10. The elimination of the rigid material 32 creates a living hinge 42 between the panel sections. These rigid panel sections define the three main panels that create the cover consisting of the back panel 10*a*, the center panel 10*b*, and the front panel 10*c*, best seen in FIGS. 9 and 10.

The following is a detailed description for each of the panels that make the cover structure.

Figure 11:
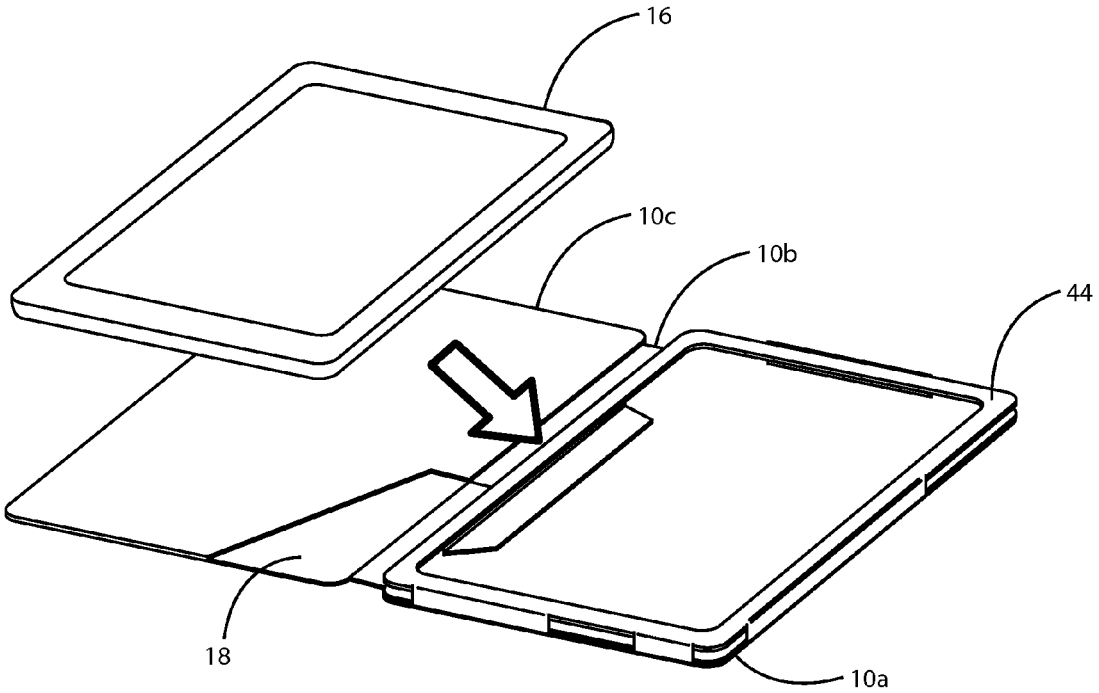
FIG. 11 shows the open device cover with an alternative method for attaching the electronic device—by way of a sleeve for device to slide into. The electronic device is shown to the right side of the sleeve where it slides into (shown with a directional arrow for clarity).

The back panel 10*a* is comprised of three layers and is the panel which the electronic device is attached to. The layers of materials are glued and sewn together to form the panel structure. The outer surface 14 of the back panel 10*a* is comprised of a durable surface material 14 (along with the rigid board material 32 as described above). The inner panel surface 12 is a softer material and is also adhered to the rigid board material 32 (as described above) and is the surface where the electronic device 16 is attached to through such methods as elastic loop fasteners 26 that are sewn onto the inside surface 12 of back panel 10*a*, best seen in FIG. 2, which also shows that the fasteners 26 extend inwardly beyond an inner surface 12 of the panel 10*a* in position for attachment to the hand held electronic device 16 as also shown in FIGS. 3-6. Another form of electronic device 16 attachment can be achieved by inserting the electronic device 16 into a pocket sleeve 44 (possibly made out of similar fabric materials) that is sewn or adhered to the back panel 10*a* inner surface 12, best seen in FIG. 11. Pocket sleeve 44 can also be considered to comprise a fastener. In-between and adhered to the outer and inner surface materials of the back panel is an additional layer comprised of a rigid plastic sheet 36 (or similar rigid material), best seen in FIGS. 9 and 10. A portion of this middle layer is exposed on the outer surface of the back panel 10*a* from a cut-out section 24 in the outer surface of the back panel, best seen in FIGS. 7 and 8. This exposed surface 34 is covered with the same material as that of the outer surface 14 which is the durable outer skin material. This exposed surface 34 matches the contour shape of the flap 18 where the flap 18 overlaps with the back panel 10*a* when the flap is in the closed position. This cut out section 24 and exposed portion 34 is where the flap 18 is magnetically attached when it is secured to the cover's back panel 10*a*. The cut-out section 24 on the back panel 10*a* also allows the flap 18 to be flush with the surface of the back panel 10*a* when the flap 18 is attached, best seen in FIG. 8. Adhered to the underside of this exposed fastening surface 34 of the middle surface material is a magnet 38 that secures the flap 18 (with its own magnet 40) to this surface 34 when the flap 18 is closed, best seen in FIG. 7.

Figure 7:
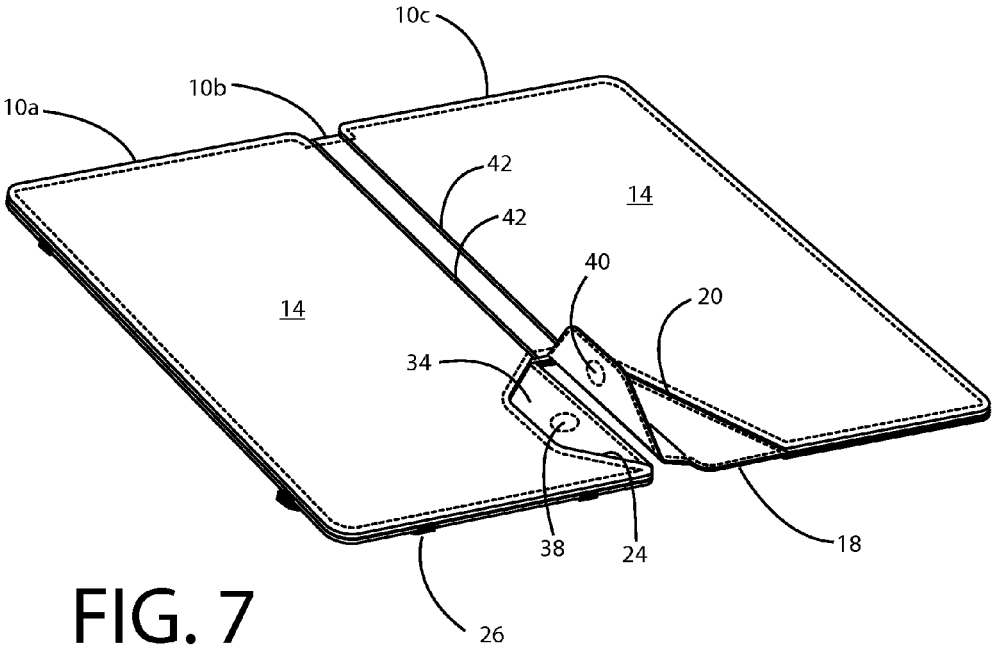
FIG. 7 shows the backside of the open device cover with the magnetically attached hinged flap slightly above the fastening surface on the back cover.
Figure 8:
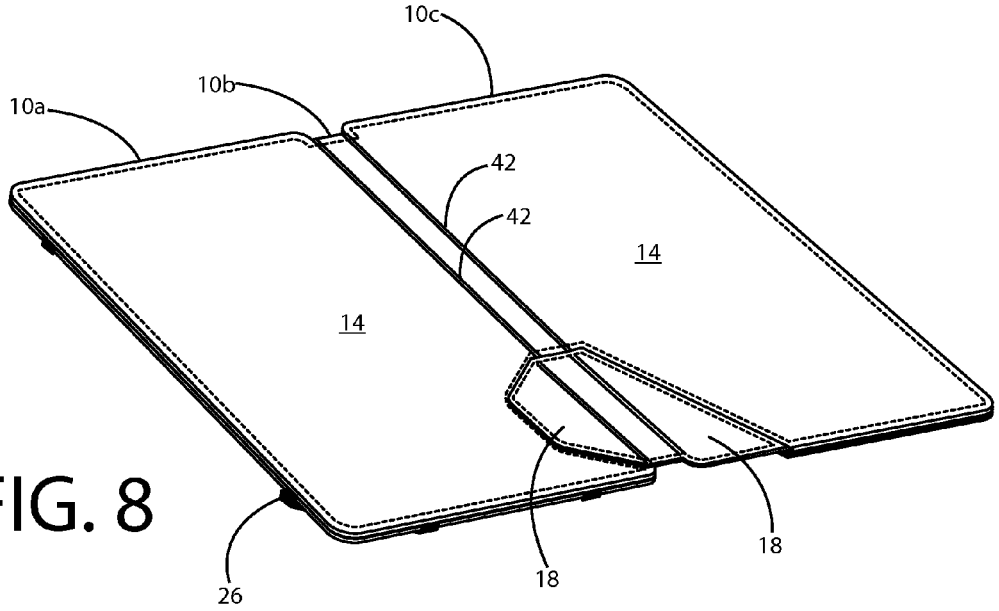
FIG. 8 shows the backside of the open device cover with the flap in the closed position—magnetically attached to the covers back surface.

The center panel 10*b*, or spine, is connected to both the back panel 10*a* and front panel 10*c* by a "living" hinge 42 that is created by eliminating the rigid "board" like material 32 from the inner 12 and outer 14 surface materials, best seen in FIGS. 2,7, and 8. The inside surfaces of the back panel 10*a*, the front panel 10*c* and the spine 10*b* are each flat, as shown in FIGS. 2-8. The rigid surface of the center panel provides a natural placement location for the hand's thumb to grasp the cover when the hand is inserted into the notch of the cover, best seen in FIGS. 12 and 13.

The front panel 10*c* is connected to the center panel 10*b* by way of a living hinge 42 as previously described. This panel—10*c*—is comprised of two layers—a durable outer material 14 and a softer inner material 12 (with each material glued to a rigid board material 32 that provides rigidity as previously described). The outer and inner surfaces are glued and sewn together to form the front panel 10*c* structure. Integrated into the front panel 10*c* structure of the cover 10 is a "flap" panel 18 that is attached and additionally hinged to the cover's front panel 10*c* structure, best seen in FIG. 4. The hinged flap 18 is attached to front panel 10*c* by a tab 22 (on the flap 18) that is glued and sewn to the outer and inner surfaces on the front panel 10*c*, best seen in FIGS. 9 and 10. The tab 22 is made from flexible material, such as the softer material used for the inner panels 12 of the cover 10. The flexible material that makes the tab 22 acts as a hinge 20 for the flap 18 to pivot on, best seen in FIG. 4. The flap 18 structure is composed of three connected panels that hinge by way of living hinge 42 , best seen in FIG. 10, so that the flap 18 will conform to the shape of the cover 10 when the cover 10 is open (best seen in FIGS. 7 and 8)—or when the cover is closed (best seen in FIG. 1) and the flap 18 is magnetically attached to the back panel 10*a*.

The flap 18 is composed of similar materials to that of the cover 10 material. The outer surface 14 is a durable material that matches the outer material 14 of the cover 10 while the inner surface 12 matches the material of the inner surface 12 of the cover 10. Rigid board material panels 32 are adhered to both the outer 14 and inner 12 surface materials and these panels are adhered to each other. In-between the outer surface and inner surface material of the flap is a magnet 40 that is used to secure the flap 18 to the outside of the back panel 10*a*, best seen in FIGS. 7, 8 and 10.

Figure 1:
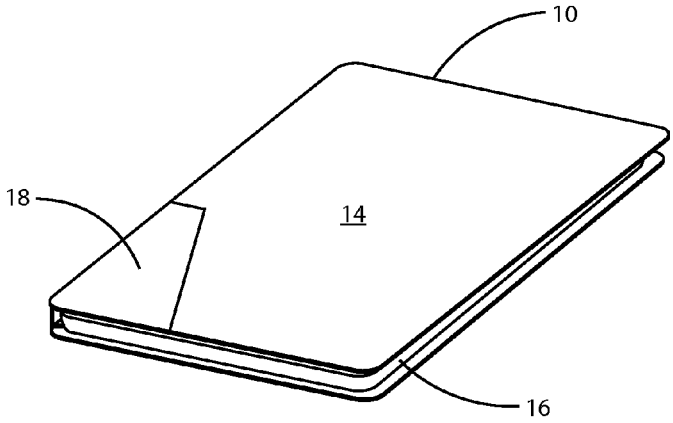
FIG. 1 shows the electronic device cover with the electronic device enclosed in the cover "closed" position. The hinged door is also shown in the "closed" and unhinged position where it is secured to the back of the device cover.

The three primary cover panels—consisting of the back panel 10*a*, the center panel 10*b*, and the front panel 10*c*—are connected to each other through living hinges 42 as previously described, which allow the cover 10 structure to fold and close like a book, best seen in FIG. 1. When the cover 10 is in the open position, the electronic device 16 is exposed and is usable, best seen in FIGS. 3 and 6.

The hinged flap 18, as previously described, is the main component of the disclosed invention for a cover 10 for an electronic device 16. When the cover 10 is in the open position, the hinged flap 18 is released from the magnetic fastener (or other fastening system) on the back panel 10*a* of the cover 10. An open area 30—or notch—is exposed from the release of the flap which allows a user's hand 28 to be inserted into the open area 30 and cradle the electronic device 16 and/or cover 10 more securely and freely—while the device 16 is securely attached to the cover 10 structure, best seen in FIGS. 4, 5, and 6.

Figure 17:
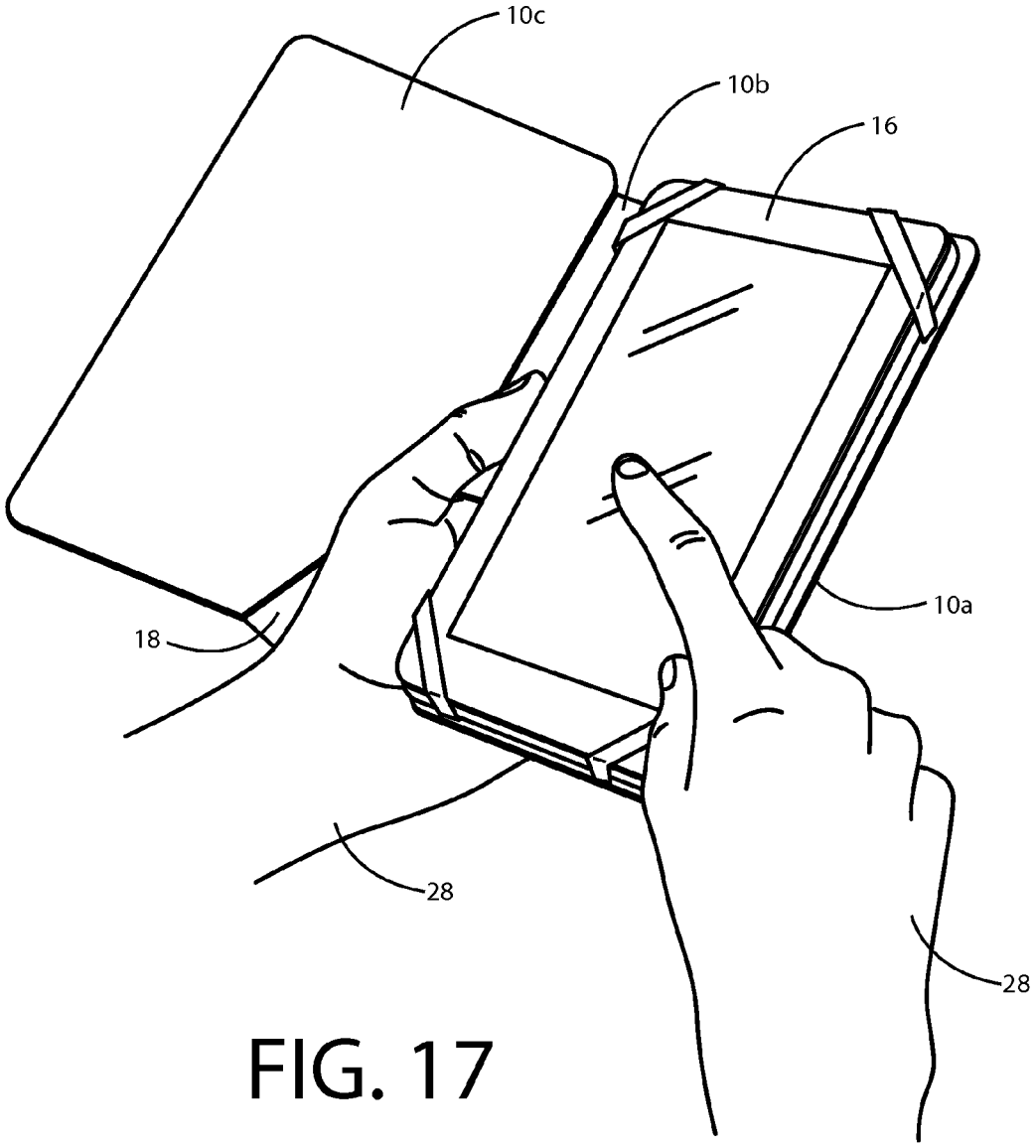
FIG. 17 shows how the cover allows a portable, handheld electronic device to be held in one hand at a position which will allow input with the opposite hand in a position to promote hand eye coordination, since the two hands will be generally side by side.

The angle for the hinge 20 of the flap 18 is significant. In the representative embodiment, the flap hinge 20 is angled at 25 degrees (plus or minus 5 degrees) to the vertical spine (or center panel 10*b*) of the cover, best seen in FIG. 5, although other angles may be acceptable. The angle of the flap hinge 20 is what creates a tapered shaped notch 30. This tapered shape allows the cover to conform around the hand 28 when the hand 28 is inserted into the open area 30 (notch) created from the release of the hinged flap 18. The tapered shaped notch 30 produces a tighter fit to the hand 28 as the open space between the cover 10 and the hand 28 is narrowed—by the further advancement of the hand 28 into the notch 30. As the angle of the notch 30 narrows, the fit between the hand 28 and the cover 10 becomes more secure and snug, best seen in FIGS. 6 and 12. With the hand 28 inserted into the notch 30 and holding the electronic device 16 securely, the users other hand is free to interact with the electronic device 16, as best seen in FIG. 17.

Because the flap hinge 20 is attached and integrated into and between the materials of the front panel 10*c* of the cover 10, the flap 18 does not rotate freely past 90 degrees of the hinge 20 and loosely hangs at an angle normally around 45 degrees, best seen in FIG. 4. This allows the inside of the flap 18 to loosely conform to the backside of the hand 28 when the hand 28 is inserted into the notch 30, best seen in FIG. 16. This provides a more secure feel and fit for the user.

The notch 30 may vary in size, depending on the hand size of the user or device size. For example; a child may utilize a cover with a smaller notch 30 to better conform the child's smaller hand. Users with larger hands may utilize a cover with a larger notch 30 that would better fit to the size of a larger hand. A cover for a smaller electronic device, such as a smart phone, may utilize a smaller notch.

The following describes the user interface with the unique cover design. The user begins with opening the cover 10 which exposes the electronic device 16 attached within. The user then releases the magnetically secured hinged flap 18 from the back panel 10*a* of the cover 10, best seen in FIGS. 3 and 4. Once the notch 30 is exposed from the opening of the hinged flap 18, the hand 28 is inserted into the notch 30 on the cover 10 in the following manner. The hand 28 is positioned with the palm up and the thumb and index finger spread apart and inserted into the open notch area 30. The electronic device 16 and/or spine 10B of cover can be grasped with the hand 28 by the closing of the thumb and index finger(s), thus grasping the electronic device and cover with the thumb and index finger(s) with fingers being positioned under the backside of the cover 10*a* and electronic device 16, best seen in FIG. 6 and FIG. 17.

The notch 30 in the cover 10 provides a cradling support between the hand 28 and the cover 10. The cradling effect (created from the notch 30 and hand 28 interaction with the cover, best seen in FIGS. 12 and 16) allows the cover 10 (with electronic device 16 attached) to rest against the gap between the thumb and the index finger and prevents the cover 10 with device 16 from moving left or right from the hand. When the hand 28 (inserted into the notch 30 of the cover 10) and electronic device 16 are angled upward toward the user, gravity keeps the cover 10 and device 16 securely positioned and cradled in the hand 28 with little or no grasping effort, best seen in FIG. 12. This feature is significant in preventing user fatigue from extended use of hand holding of the electronic device.

Figure 12:
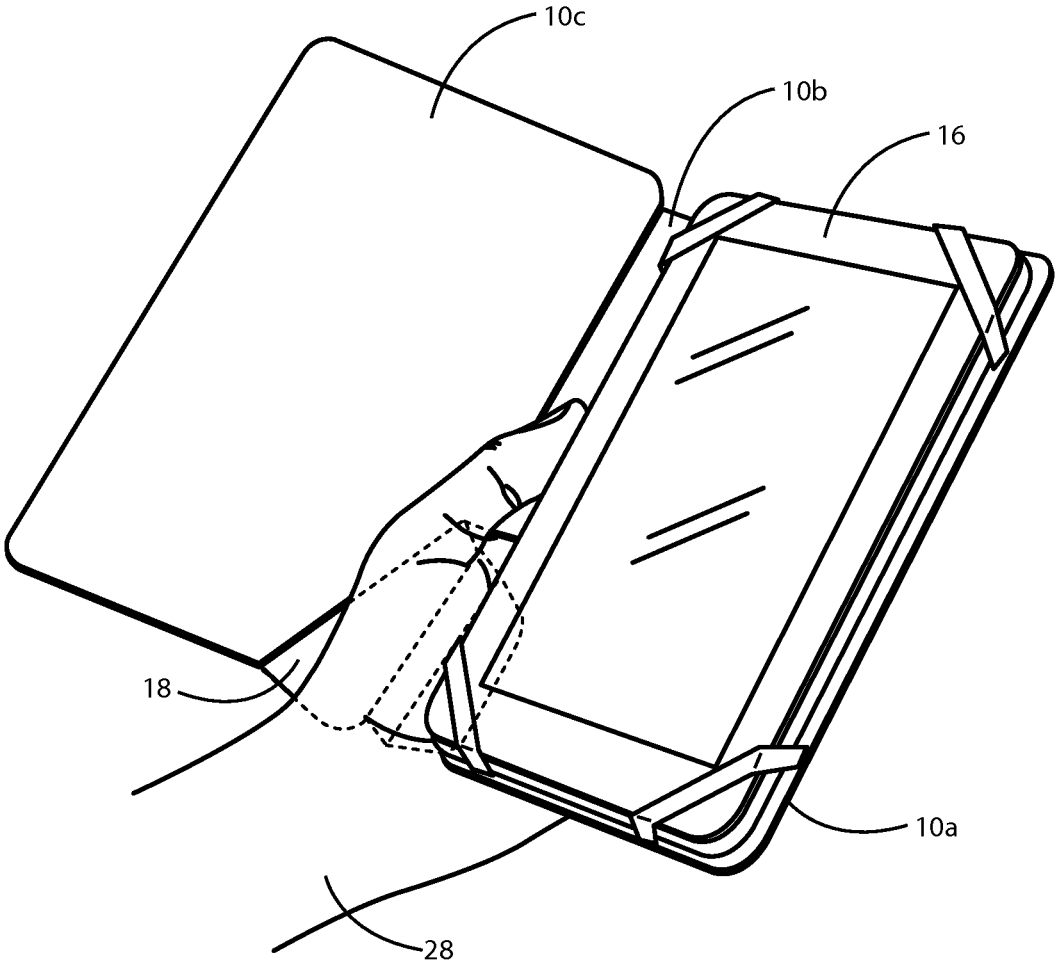
FIG. 12 shows the open device cover with a human hand that is inserted into the notch holding the electronic device. The hand is holding the device at a natural upward angle appropriate for viewing the screen on the electronic device.

When utilizing the cover, the notch positions the support hand 28, or left hand, at an elevated position on the device, about half way up the device, best seen in FIG. 12. This places the support hand and the data entry, or right hand, at approximately the same elevation when entering data into the device, or interacting with the device with your data entry hand, best seen in FIG. 17. This positioning of the hands, while interacting with the device, supports hand-eye coordination because of a more natural position for the hands to be placed in while interacting, or entering data, with the device. With the user's two hands positioned beside each in a more natural position, as they are when using the cover with the notch, the user has greater control of the electronic device which leads to better hand-eye coordination when entering data into the device. This feature can be particularly advantageous when using the electronic device for playing games where hand/eye coordination is needed.

When the hinged flap 18 is not utilized and is fastened to the back panel 10*a* of the cover, the cover 10 operates as a normal cover creating a uniform cover that provides full protective coverage over the surface of the electronic device 16, best seen in FIGS. 1,3, and 8.

In an alternative design version, the notch 30 can be integrated into the cover without a flap 18. The notch 30 is simply an exposed open space when the cover is in the open position that does not have a flap 18—which is used to close off the open space.

Another design alternative offers a version with the notch 30 on the right side of the open cover 10 and the device 16 mounted to the left side of the open cover—basically a mirror image of the former detailed description. This version specifically addresses the needs of users who prefer to hold the device in their right hand.

Figure 14:
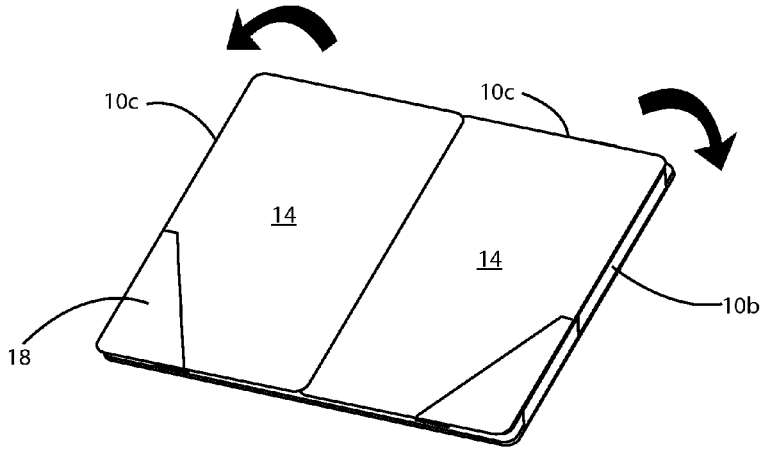
FIGS. 14 and 15 shows an alternate version for a cover designed with two overlapping covers that provide notches on either side of the electronic device allowing the user to hold the device with either hand or both hands. The electronic device is shown in the horizontal position, but the cover could be designed for either horizontal or vertical device layout.
Figure 15:
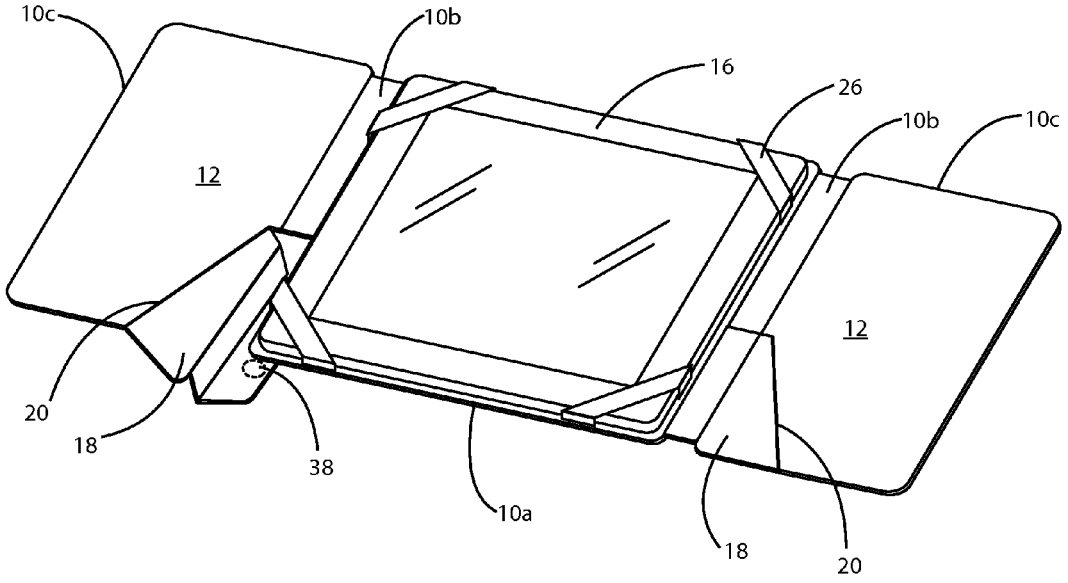

Yet another alternative design offers a version with the notch 30 on both the right and left sides of the open cover 10—a cover that consist of 2 top panels 10*c* with a notch 30 integrated into each top panel, best seen in FIGS. 14 and 15. The device 16 is mounted in the center of the open covers. If one of the top panels 10*c* (with the notch) is not used, it can fold back and attach to the back surface of the back panel 10*a*. If the cover is closed, the two top panels fold inward and can be attached to each other through various fastening systems.

The unique cover design is not limited to electronic devices that are oriented in a vertical position as illustrated in most of the drawings. The cover can be designed to utilize electronic devices that are oriented in a horizontal position (or landscape position), as best seen in FIG. 15.

The unique invention of this cover is not limited to a single cover product as described in this application and may be integrated as a component of other products or devices. Likewise, other features may be incorporated into the unique cover, such as pockets to hold other devices or accessories such as cell phones, etc. Straps may be integrated as a feature of the cover to aid in carrying or transporting.

The terms and expressions which have been employed in this specification are used therein as terms of description and not of limitation, and there is no intention in the use of such terms and expressions to exclude equivalents of the features shown and described or portions thereof, it being recognized that the scope of the invention is defined and limited only by the claims which follow.

I claim:

1. An article for supporting a separate portable, hand held electronic device comprising:

a back panel with multiple fasteners on the panel for mounting the hand held electronic device to the panel in a position for use of the hand held electronic device while fastened to the article wherein the fasteners on the panel are located adjacent peripheral edges of the panel; device;

a second section of the article comprising a front panel extending beyond one side of the panel;

a notch, one portion of which extends to the one side of the panel, and extending into the second section adjacent the one side of the panel, the notch extending from a lower edge of the second section, wherein the notch is dimensioned to allow a user to fit his or her hand between his or her thumb and fingers into the notch so the user can support the article and to assist the user in supporting and using the hand held electronic device mountable thereon, with only one hand during use of the hand held electronic device;

wherein a flap extending from an inclined edge of the front panel rests against the rear surface of the user's hand when positioned in the notch.

2. The article of claim 1 wherein the notch is tapered from a relatively wider mouth at the lower edge to a narrower section intermediate the bottom edge and a top edge of the panel.

3. The article of claim 1 wherein the second section is hinged relative to the panel.

4. A cover for a separate portable, hand held electronic device comprising:

a front cover panel;

a back cover panel to which the portable, hand held electronic device is mountable on the back cover panel, by multiple fasteners located on the back cover panel adjacent peripheral edges of the back cover panel and extending inwardly from an inner surface of the panel in position for use of the hand held electronic device while mounted on the back cover panel; and a notch, defined in part by one side of the back cover panel, between the front cover panel and the back cover panel, the notch having a width and a height to provide space to receive a user's hand, between the user's thumb and fingers to cradle the back cover panel and to assist the user to hold and use the portable, hand held electronic device in the user's hand during use of the hand held electronic device, wherein a flap extending from an inclined edge of the front panel rests against the rear surface of the user's hand when positioned in the notch.

5. The cover of claim 4 wherein a portion of the notch extends into the front cover panel.

6. The cover of claim 4 wherein a hinge is located between the front cover panel and the back cover panel, the dimensions and position of the notch allowing access through the notch by a user's hand to engage, when the second section is in a flat configuration, an outside surface of the panel opposite from an inside surface on which the portable, hand held electronic device is mountable, the notch extending into the hinge.

7. The cover of claim 4 wherein the notch is tapered from a relatively wider section adjacent a lower edge of the front cover panel and the back cover panel to a relatively narrower section intermediate the lower edge and an upper edge of the front cover panel and the back cover panel.

8. The cover of claim 7 wherein the notch is formed between a side edge of the back cover panel, extending perpendicular to a lower edge of the back cover panel, and a portion of an edge on the front panel inclined at an angle relative to the side edge of the back cover panel.

9. The cover of claim 7 including the flap that is hinged relative to one of the front cover panel and the back cover panel, the flap being shiftable to open and close the notch.

10. The cover of claim 9 wherein the flap extends over the notch to close the notch, when the front cover panel is folded over the portable, hand held electronic device when not in use.

11. The cover of claim 10 wherein the flap is attachable to and detachable from the one of the front cover panel and back cover panel to which the flap is not hinged.

12. The cover of claim 4 wherein the front and back cover panels are covered by a flexible material, the flexible material forming a hinge between the front and back panels.

13. The cover of claim 12 wherein a third panel extends between the front and cover panels to form a relatively rigid spine between the front and back panels, the flexible material forming a hinge on opposite sides of the spine between the spine and the front and back panels.

14. The cover of claim 4 wherein fasteners are positioned on an inside surface of the back cover panel to secure the portable, hand held electronic device to the cover in a position in which the cover and the hand held electronic device mounted therein can be held in a single for use of the hand held electronic device.

15. The cover of claim 4 comprising an e-book reader cover sized to conform to an e-book.

16. The cover of claim 4 comprising a tablet computer cover sized to conform to a tablet computer.

17. The cover of claim 4 comprising a smart phone cover sized to conform to a smart phone.

18. A cover for mounting a separate portable, hand held electronic device, which has a display suitable for user interaction, the cover comprising:

a back panel to which the portable, hand held electronic device is securable on the back panel by multiple fasteners, all of which are located on the back cover panel adjacent peripheral edges of the back panel;

a front panel shiftable relative to the back panel and to the portable, hand held electronic device mountable on the back panel, between an open position in which the display is visible and accessible and a closed position in which the front panel extends over the portable, hand held electronic device;

a hinge, including a spine, between and joining the front panel and the back panel and adjacent an edge of the back panel, the front panel being shiftable between the closed and the open position about the hinge; and a notch extending into the hinge and the spine to provide an opening positioned for cradling the back cover panel to assist a user to hold and use the portable, hand held electronic component mountable thereon in the user's hand;

where a flap extending from an inclined edge of the front panel rests against the rear surface of the user's hand when positioned in the notch.

19. The cover of claim 18 wherein the notch is formed in part by an inclined edge on the front panel, the inclined edge being configured to rest on a rear surface of the user's hand when positioned in the notch, the cover, and the portable, hand held electronic device mountable thereon being supported by engagement of the user's hand on both the back front panel and the front panel.

* * * * *